United States Patent [19]

Larson et al.

[11] Patent Number: 4,700,559

[45] Date of Patent: Oct. 20, 1987

[54] APPARATUS FOR REPAIRING DEFORMED, YIELDABLE STRUCTURES

[76] Inventors: Byron A. Larson, 116 LaCrosse Ave., S. San Francisco, Calif. 94080; John J. Molteni, 540 Keelson Cir., Redwood City, Calif. 94065

[21] Appl. No.: 914,186

[22] Filed: Oct. 1, 1986

Related U.S. Application Data

[62] Division of Ser. No. 778,802, Sep. 23, 1985, Pat. No. 4,643,015.

[51] Int. Cl.[4] ..... B21D 1/12

[52] U.S. Cl. ..... 72/461; 72/705

[58] Field of Search ..... 72/705, 461; 254/100

[56] References Cited

U.S. PATENT DOCUMENTS

| | | | |
|---|---|---|---|
| 1,786,589 | 12/1930 | Williamson | 269/296 |
| 1,854,055 | 4/1932 | Montgomery | 254/100 |
| 2,451,307 | 10/1948 | South | 72/705 |
| 2,692,002 | 10/1954 | Merrill et al. | 72/705 |
| 2,717,020 | 9/1955 | Dobias | 72/705 |
| 3,034,564 | 5/1962 | Cavazos | 72/705 |
| 3,340,720 | 9/1967 | Chartier | 72/705 |
| 3,518,867 | 7/1970 | Rouis | 72/705 |
| 3,749,364 | 7/1973 | Sanchez | 72/705 |
| 3,796,081 | 3/1974 | Jarman | 72/447 |
| 3,893,329 | 7/1975 | Roes | 72/457 |
| 4,055,061 | 10/1977 | Bayorgeon et al. | 72/32 |
| 4,151,737 | 5/1979 | Specktor | 72/457 |
| 4,289,016 | 4/1981 | Hare | 72/457 |
| 4,313,335 | 2/1982 | Eck | 72/705 |
| 4,313,336 | 2/1982 | Eck et al. | 72/705 |
| 4,336,705 | 6/1982 | Specktor | 72/457 |
| 4,370,882 | 2/1983 | Labbe | 72/705 |
| 4,386,517 | 6/1983 | Harmon | 72/455 |
| 4,398,410 | 8/1983 | McWhorter et al. | 72/705 |

FOREIGN PATENT DOCUMENTS

| | | | |
|---|---|---|---|
| 944671 | 4/1974 | Canada | 72/705 |
| 50-37143 | 7/1975 | Japan . | |

OTHER PUBLICATIONS

Continental Collision Repair Systems, 1984, "A Total Collision Repair System".

Bee Line Automotive Equipment, "The All New--Model 12,000 Bee-Liner".

Bee Line Alignment Equipment, "Bee Line Accu--Trak".

Chief Automotive Systems, Inc., "Chief E.Z-Liner II", 1984.

Car Bench, s.p.a., "Mobile Bench".

Nicator Systems, "Dataliner 80".

Applied Powers Inc., "Blackhawk".

*Primary Examiner*—Lowell A. Larson

*Attorney, Agent, or Firm*—Jack M. Wiseman

[57] ABSTRACT

An apparatus for repairing a deformed, yieldable body of a motor vehicle. The apparatus includes a frame on which a raised platform is secured. To restrain the vehicle during the application of a restoring force, various appliances are attached at any location about the outer boundary of the platform and coupled to the motor vehicle. The appliances are adapted to be attachable to and releasable from the motor vehicle without requiring its movement. To apply the force necessary to restore the deformed, yieldable body of a motor vehicle, the apparatus includes pull-towers supported on and movable along a track provided by the frame. Each pull-tower includes a compact power head which can be moved vertically up or down the pull-tower. Activating the power head produces the force used in restoring the deformed, yieldable body of the motor vehicle.

1 Claim, 9 Drawing Figures

APPARATUS FOR REPAIRING DEFORMED, YIELDABLE STRUCTURES

BACKGROUND OF THE INVENTION

Related Application

This application is a divisional application of our copending application, Ser. No. 06/778,802, filed on Sept. 23, 1985, now patent No. 4,643,015 for Apparatus For Repairing Deformed Yieldable Structures, granted Feb. 17, 1987.

FIELD OF THE INVENTION

The present invention relates generally to force applying devices, and more particularly to apparatus for repairing a deformed, yieldable structure.

DESCRIPTION OF THE PRIOR ART

Apparatus for repairing the body of a motor vehicle which positions the vehicle on and secures it to a raised, integrated frame/platform are known. Examples of such apparatus are disclosed in U.S. Pat. No. 4,151,737 and U.S. Pat. No. 4,365,705, both of which are entitled "Apparatus For Repairing and Straightening" which issued respectively on May 1, 1979 and June 29, 1982, to Gerald A. Specktor ("the Specktor Patents"), and in U.S. Pat. No. 4,313,335 entitled "Vehicle Work Rack Structure" issued Feb. 3, 1982 to Leonard F. Eck ("the Eck Patent"). In each of the preceding patents, the motor vehicle is secured to the raised, integrated frame/platform while a force is applied to the vehicle from one or more vertical pull-towers secured to and locatable about the perimeter of the frame/platform.

The integrated frame/platforms which are disclosed in both the Specktor Patents and the Eck Patent include a plurality of apertures formed therethrough which are used in restraining the motor vehicle while a repair is being made. In the Specktor patents, the integrated frame/platform includes apertures adapted to receive a bolster which engages and restrains a frame member of a motor vehicle. Two difficulties are present with this particular technique for restraining a vehicle during repair. The first is that it requires precise positioning of the vehicle with respect to the aperture so the bolster may be properly mated with the frame member. The second is that there are a limited number of locations at which the bolster may be positioned on the apparatus. In the Eck Patent, the apertures formed through the frame/platform receive and secure one end of a chain. The other end of the chain is secured to the motor vehicle. While the use of a chain rather than a bolster to secure the motor vehicle to the integrated frame/platform relaxes the requirement for precise vehicle positioning, the vehicle is moved prior to repair relative to the frame/platform to remove slack from the chain and is moved after completing the repair relative to the frame/platform to release the tension in the chain. Further, the use of apertures formed through the frame/platform to receive one end of the chain limits the possible locations at which the chain may be secured.

The pull-towers secured to the integrated frame/platform as disclosed in the aforementioned patents employ comparatively cumbersome structures to couple a force generated by an hydraulic cylinder to a location on the motor vehicle. The Specktor Patents disclose one example of a class of pull-towers in which an hydraulic cylinder is secured within the pull-tower with the movable end thereof extending out of the top of the pull-tower.

An upper pulley is secured at the end of the hydraulic cylinder extending out of the top of the pull-tower. A chain is arranged in an inverted U-shaped configuration over the upper pulley and secured at one end to the pull-tower immediately beneath the pulley. From the upper pulley, the remaining portion of chain extends downwardly along one side of the pull-tower to a lower pulley. The lower pulley is mounted on a collar which surrounds the pull-tower and may be secured thereto at any vertical location along the pull-tower. Raising or lowering the collar on the pull-tower raises or lowers the location from which a force may be applied in repairing a vehicle.

In the type of pull-tower disclosed in the Specktor Patents, energizing the hydraulic cylinder extends the hydraulic cylinder vertically out of the pull-tower. This action raises the upper pulley of the chain extending outwardly from the lower pulley and draws the portion toward the pull-tower. In addition to generating a force urging the portion of the chain that extends from the lower pulley to be drawn inwardly toward the pull-tower, the extension of the hydraulic cylinder also applies a substantially equal force urging the collar on which the lower pulley is mounted to rise upwardly on the pull-tower. Frequently, the collars of pull-towers of the type disclosed in the Specktor Patents slip upwardly along the pull-tower while a repair is being made, because the collar must always resist a force urging it upwardly along the pull-tower which is substantially equal to the force being applied in repairing the body of a motor vehicle.

An example of a second class of pull-towers is disclosed in the Eck Patent. In this second class of pull-towers, rather than raising an upper pulley located at the top of the pull-tower to couple force generated by an hydraulic cylinder to a chain, such force transfer is achieved by having the hydraulic cylinder act upon a hinged lever arm to which one end of the chain is secured. In one type of pull-towers belonging to this second calss, the force applied by this hinged lever arm to the chain is applied directly to a location on a structure being repaired. The place at which the chain is attached to the hinged lever arm establishes the location from which force is applied to the vehicle. In a second type of pull-tower also belonging to this second class, the chain extending from the lever arm to the motor vehicle passes around a pulley rotatably secured on a pin inserted through a pair of holes formed through the pull-tower. A plurality of such hole pairs formed through the pull-tower permits selection of various locations from which a force may be applied to a vehicle.

There is also a third class of pull-towers in which the hydraulic cylinder extends outwardly from a collar secured about the pull-tower which collar may be moved up and down along the pull-tower. In this type of pull-tower, force generated by the hydraulic cylinder acts between the pull-tower and a yoke to which both ends of a chain are secured. The chain between the ends which are secured to the yoke extends outward therefrom on opposite sides of the pull-tower to the location on a vehicle at which force is to be applied in repairing the body. One disadvantage of this arrangement is that the hydraulic cylinder extends outwardly in an awkward manner away from the frame/platform into the space surrounding the apparatus. Another disadvantage of this arrangement is that the force generated by the pull-tower must be directed at right angles thereto.

Consequently, it is possible to apply an upwardly or downwardly sloping force in repairing the body of a motor vehicle only if the pull-tower may be arranged along a sloping angle which is the complement of the direction of the desired sloping force.

In the Specktor Patents, movement of the pull-towers about the perimeter of the frame/platform is achieved by rotating them in a horizontal plane about fixed axes of rotation passing through the frame/platform. Conversely, the pull-towers of the Eck Patent are movable along an oval track established by the frame/platform. In the event there is failure in the structure which attaches the pull-tower to the frame/platform while repairing the body of a motor vehicle, then the pull-tower disclosed in both the Specktor Patents and the Eck Patent will simply fall off the respective apparatus. The possibility of such a failure may expose an operator of either apparatus to bodily injury.

SUMMARY OF THE PRESENT INVENTION

An object of the present invention is to provide an apparatus which is more easily adapted for repairing a deformed, yieldable structure.

Another object of the present invention is to provide an apparatus for repairing a deformed, yieldable structure having a simplified arrangement for applying a force to the deformed structure while it is being repaired.

Another object of the present invention is to provide an apparatus for repairing a deformed, yieldable structure for which it is unnecessary to move the structure in securing it to or releasing it from the apparatus.

Another object of the present invention is to provide an apparatus for repairing a deformed, yieldable structure which is safer to operate and reduces the possibility of injury to an operator during the repair of a deformed, yieldable structure.

Briefly, the present invention includes a frame supported upon and disposed above the ground for supporting one or more pull-towers. A raised platform includes two elongated parallel surfaces disposed within and rigidly secured to the frame on opposite sides thereof. The frame receives a deformed motor vehicle for repair. To restrain the vehicle while a repair is being made, various appliances attached at any location about the outer boundaries of the platform are coupled to the vehicle. Thus, appliances, such as a hold-back anchor and a bladed holding standard restrain a vehicle from moving away from the point of attachment between the appliance and the outer boundaries of the platform during the application of force in restoring the deformed body of the vehicle.

The hold-back anchor is an appliance which attaches to the outer boundary of the platform at any location. In its preferred embodiment, each hold-back anchor includes a threaded rod. At one end of the threaded rod is attached a claw hook for grasping one end portion of a chain. The chain may be secured at an opposite end portion to the vehicle. Rotation of a tension nut threaded onto the rod at its end remote from the claw hook either removes slack from or releases tension in the chain without moving the vehicle dependent on the direction of rotation of the tension nut.

A bladed holding standard restrains a particular location on a vehicle while a damaged area is pulled to one side or is spread apart. The holding standard is positioned on the platform of the apparatus beneath the location on a vehicle at which it is to be held. A base of the holding standard rests either partially or fully on a sliding anchor beam which is supported between the parallel surfaces of the platform of the apparatus. The holding standard includes a blade which projects upwardly from the base of the holding standard to a height at which it contacts the vehicle being repaired. An anchor bolt is secured through both the base of the holding standard and the sliding anchor beam upon which it rests. A hook at one end of a chain is also attached to the base of the holding standard remote from its blade. The chain is disposed across the platform to be secured in a claw hook of a hold-back anchor attached to the outer boundary of the platform and all slack is removed from the chain by tightening the tension nut of the hold-back anchor. The bladed holding standard may be used in repairing motor vehicles having either a conventional frame or a unibody structure.

The pull-towers are supported on and move along a track provided by the frame of the apparatus to be positioned at various locations about a vehicle. The frame of the apparatus is formed with an outer boundary which extends outwardly beyond the raised platform and encompasses the outer boundary of the raised platform. Thus, the presence of various appliances, such as hold-back anchors, attached to the outer boundaries of the platform for restraining a vehicle while it is being repaired do not obstruct movement of the pull-tower along the frame. Further, the structure by which a pull-tower is attached to the frame of the apparatus urges the pull-tower to move inwardly toward the frame if the structure fails while a repair of the vehicle is being made.

Each pull-tower includes a compact power head for applying a force to a vehicle for restoring the deformation thereof. In the preferred embodiment, the power head may be raised and lowered along the pull-tower by means of a winch secured to the top of the pull-tower only if a force is to be applied along a sloping direction which is not perpendicular to the pull-tower. The power head includes a hydraulic cylinder aligned parallel to the pull-tower and is located below an upper pulley. The upper pulley is secured to the highest end of the hydraulic cylinder. One end of a chain is secured to the power head. The power head is disposed along an inverted U-shaped path extending upward over the upper pulley and then downwardly and around the outer pulley. The outer end of the chain is attached to the vehicle at a location to restore the deformation of the body of the vehicle.

DETAILED DESCRIPTION OF THE PREFERRED EMBODIMENT

Figure 1:
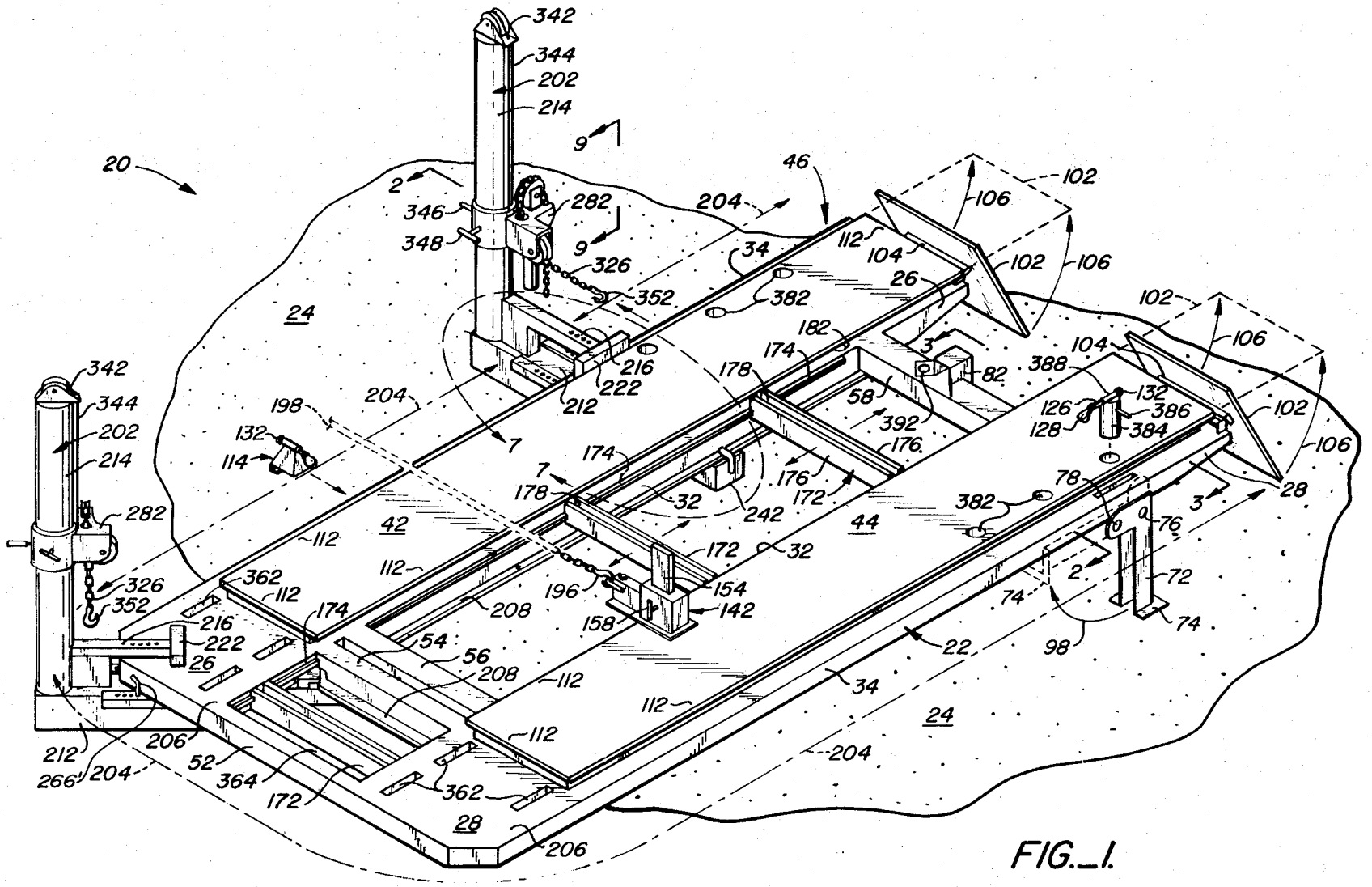
FIG. 1 is a diagrammatic perspective view partially exploded illustrating an apparatus embodying the present invention showing a frame, raised platform, pull-towers, and various appliances which may be attached to the outer boundaries of the raised platform.

Illustrated in FIG. 1 is an apparatus 20 embodying the present invention for repairing a deformed, yieldable structure, such as a motor vehicle (not shown). The apparatus 20 includes a unitary frame 22 which is disposed above a floor 24. The frame 22 includes an elongated, rectangularly shaped left frame member 26 and right frame member 28.

Figure 2:
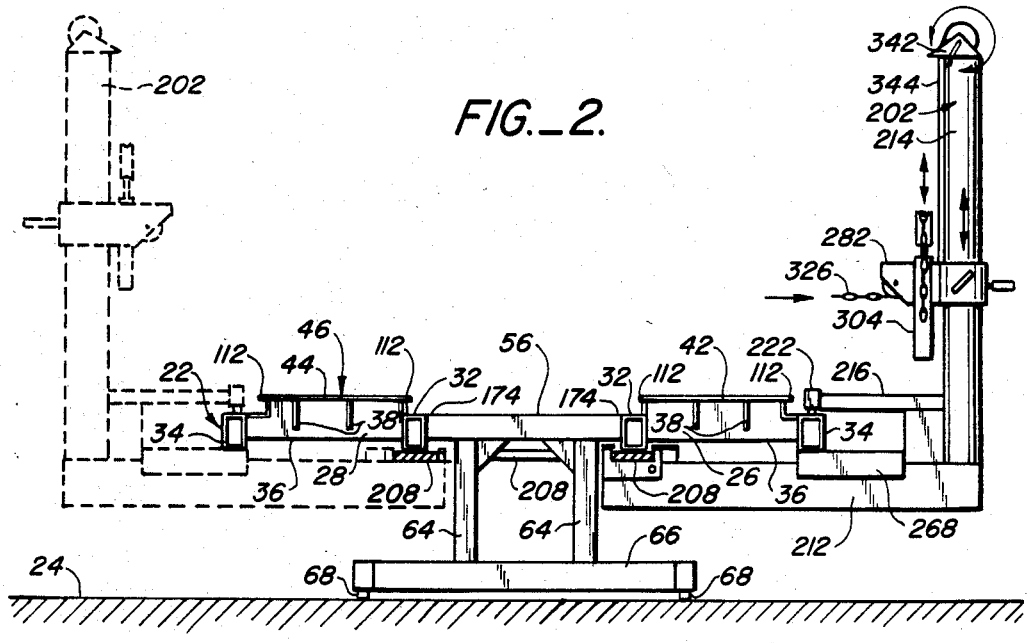
FIG. 2 is a diagrammatic cross-sectional view of the apparatus shown in FIG. 1 taken along the line 2—2 of FIG. 1 illustrating a raised platform and a frame including a track upon which the pull-towers are movably supported.

Referring now to FIG. 2, the left and right frame members 26 and 28 are formed as mirror images of each other. Thus, each frame member 26 and 28 includes both a hollow, rectangularly shaped inner beam 32 and a hollow, rectangularly shaped outer beam 34 which extend along the entire length of the left and right frame members 26 and 28. The inner and outer beams 32 and 34 are joined together by a plurality of hollow, rectangularly shaped tubes 36 located at spaced intervals along the length of each pair of inner and outer beams 32 and 34. Stringers 38 are secured between each pair of tubes 36 spaced along the length thereof between the inner and outer beams 32 and 34.

Respectively supported upon and secured to the upper surfaces of the tubes 36 and the stringers 38 of the left and right frame members 26 and 28 is an elongated, rectangularly shaped left platform surface 42 and right platform surface 44. The combined left and right platform surfaces 42 and 44 establish a platform 46 adapted to receive and support a motor vehicle while it is being repaired. Referring again to FIG. 1, the left and right frame members 26 and 28 are disposed parallel to each other and are joined together into the unitary structure of the frame 22 by a front beam 52, a forward beam 54, a forward leg attachment beam 56 and a rear beam 58. The beams 52, 54, 56 and 58 maintain the left and right platform surfaces 42 and 44 parallel to each other on opposite sides of an elongated, rectangularly shaped central aperture 62. The central aperture 62 extends downwardly through both the platform 46 and the frame 22 toward the floor 24. The frame 22 is disposed above the floor 24. Encompassing the central aperture 62 are the inner beams 32 of the left and right frame members 26 and 28, respectively, which extend between the forward leg attachment beam 56 and the rear beam 58.

Referring to FIG. 2, the frame 22 is supported at one end above the floor 24 by a pair of front legs 64 extending downwardly toward the floor 24 from the forward leg attachment beam 56. A front wheel beam 66 extends horizontally between and outwardly beyond the front legs 64 at the lower extremities thereof. A wheel 68 is secured at each end of the front wheel beam 66. The wheels 68 allow rotating the apparatus 20 about the front wheel beam 66 in addition to moving the apparatus 20 across the floor 24.

Figure 3:
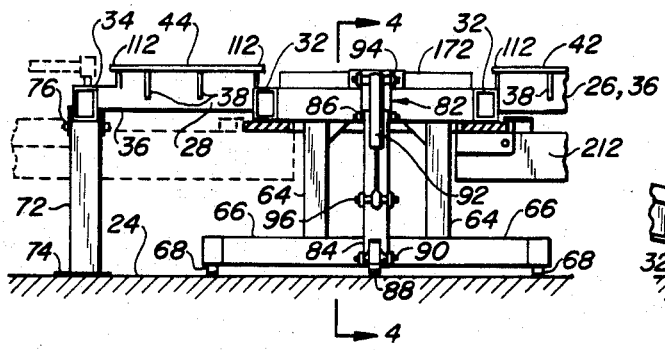
FIG. 3 is a diagrammatic cross-sectional view of the apparatus shown in FIGS. 1 and 2 taken along the line 3—3 of FIG. 1 illustrating a portion of the apparatus which lowers and raises to facilitate movement of a motor vehicle onto or off of the raised platform.

When the apparatus 20 (FIGS. 1 and 3) is raised and supported in its operating position, the end of the apparatus 20 removed from the front legs 64 rests upon a pair of hinged supporting legs 72 only one of which is illustrated in FIGS. 1 and 3. Each hinged supporting leg 72 is formed with a U-shaped cross-section and includes a U-shaped foot 74 at the end thereof which contacts the floor 24. Viewed from the side, each hinged supporting leg 72 is formed in an inverted L-shape which permits the hinged supporting leg 72 to be attached beneath the outer beam 34 by a leg hinge bolt 76 and to be maintained in the downwardly extended position beneath the beam 34 by a leg support pin 78. Each pin 78 passes beneath the associated outer beam 34 through both sides of the hinged supporting leg 72.

Figure 4:
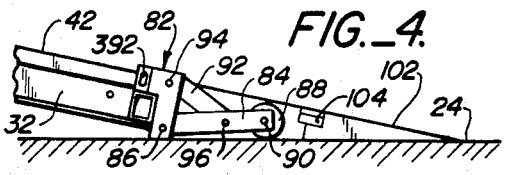
FIG. 4 is a diagrammatic cross-sectional view of a portion of the apparatus shown in FIGS. 1–3 taken along the line 4—4 of FIG. 3 depicting the apparatus in its lowered position which facilitates movement of a vehicle onto or off of the raised platform.

The apparatus 20 includes means for lowering the end thereof at which the hinged supporting legs 72 are located to the floor 24 for moving a vehicle to be repaired onto or off of the upper surface of the platform 46. Thus, the frame 22 includes a lift drive mounting bracket 82 (FIGS. 1, 3 and 4) secured to the rear beam 58 intermediate the inner beams 32. As illustrated in FIGS. 3 and 4, one end of a hinged lifting leg 84 is formed with a U-shaped cross-section and is rotatably secured at the lower end of the lift drive mounting bracket 82 through a hinge bolt 86. A wheel 88 is rotatably supported at the end of the hinged lifting leg 84 end removed from the lift drive mounting bracket 82 by a bolt 90. One end of a lifting hydraulic cylinder 92 is rotatably secured to the upper end of the lift drive mounting bracket 82 by a bolt 94, while the other end is secured to the hinged lifting leg 84 by a bolt 96.

Upon activating the lifting hydraulic cylinder 92 to extend the hinged lifting leg 84 downwardly toward the floor 24, the end of the apparatus 20 resting upon the hinged supporting legs 72 is raised so the feet 74 no longer contact the floor 24 and the apparatus 20 is raised into its fully elevated position. With the feet 74 out of contact with the floor 24, each leg support pin 78 (FIG. 1) may be withdrawn from the hinged supporting legs 72. The U-shaped hinged supporting leg 72 is swung upwardly as indicated by the curved arrow 98, thereby retracting it toward the outer beam 34. Then, the hinged supporting leg 72 may be locked in the retracted position by reinserting the leg support pin 78 through the hinges supporting leg 72. With both hinged supporting legs 72 locked in the retracted positions surrounding the outer beams 34, the lifting hydraulic cylinder 92 may then be activated to retract the hinged lifting leg 84 upwardly between the ends of the inner beams 32, thus lowering the tapered rearward ends of the inner beams 32 into contact with the floor 24.

To further facilitate moving a motor vehicle onto or off of the upper surfaces of the platform 46, a ramp plate 102 (FIGS. 1 and 4) is secured by a ramp plate hinge 104 at each end of the left and right frame members 26 and 28 extending outwardly beyond the rear beam 58. Thus, as the lifting hydraulic cylinder 92 retracts and the end of the frame 22 lowers toward the floor 24, the end of each ramp plate 102 removed from the ramp plate hinge 104 first contacts the floor 24 and then subsequently slides outwardly from the apparatus 20 along the surface of the floor 24 while rotating about the ramp plate hinge 104 as illustrated by the curved arrows 106 in FIG. 1. When the tapered rearward ends of the inner beams 32 contact the floor 24, the ramp plates 102 become coplanar with the surface of the platform 46 as illustrated in FIG. 4. With the apparatus 20 disposed in this position, a motor vehicle may be easily driven or winched onto or off of the sloping upper surface of the platform 46.

With a motor vehicle located on the sloping upper surface of the platform 46, the lifting hydraulic cylinder 92 may again be activated to raise the rear end of the apparatus 20, at which the hinged supporting legs 72 are located into a fully elevated position. With the apparatus 20 in a fully elevated position, the leg support pins 78 may be removed from each of the hinged supporting legs 72 allowing the legs 72 to swing downwardly into the extended upright position below each outer beam 34. The leg support pins 78 are reinserted through the hinged supporting legs 72 below the outer beams 34. This action locks the hinged supporting legs 72 in their extended upright positions. With the hinged supporting legs 72 located below the outer beams 34, the lifting hydraulic cylinder 92 is again activated to retract the hinged lifting leg 84 upwardly between the inner beams 32, thereby returning the feet 74 into contact with the floor 24 and disposing the apparatus 20 in its raised, operating position. With the apparatus 20 disposed in its raised, operating position, the motor vehicle is secured thereto prior to the repair of a deformed body.

Figure 5:
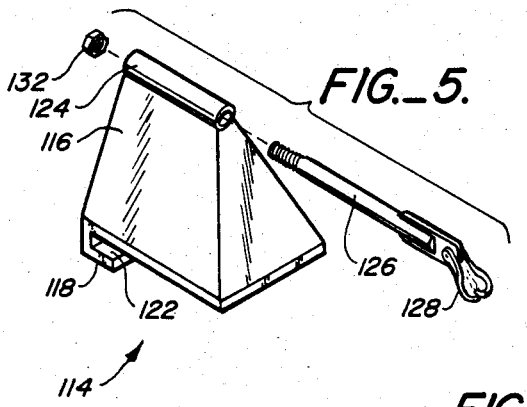
FIG. 5 is an exploded, perspective view depicting a hold-back anchor embodying the present invention adapted to be attached to the outer boundary of the raised platform.

The apparatus 20 of the present invention includes a variety of appliances adapted for securing the motor vehicle to the platform 46. To facilitate securing the motor vehicle to the apparatus 20, the left and right platform surfaces 42 and 44 are respectively formed with a flange 112 (FIGS. 1–3). The flange 112 extends entirely around the respective surfaces 42 and 44 and, define the outer boundaries of the platform 46. One type of appliance adapted to be employed in securing a motor vehicle to the apparatus 20 by mating with the flange 112 is an adjustable hold-back anchor 114 (FIGS. 1 and 5).

The hold-back anchor 114 includes a pyramidally shaped base 116 below which extends an L-shaped mounting bracket 118. The mounting bracket 118 defines a U-shaped slot 122 beneath the base 116 for engaging the flange 112 of either the left platform surface 42 or the right platform surface 44. Secured at the top of the pyramidally shaped base 116 and disposed orthogonally to the length of the slot 122 is a hollow tube 124. A rod 126 is threaded at one end and has a cup-shaped chain claw hook 128 secured to its other end. The rod 126 is inserted through the tube 124 and is mated with a tension adjusting nut 132.

To use the hold-back anchor 114 for securing a motor vehicle to the apparatus 20, the slot 122 is mated with the flange 112 at an appropriate location on the outer boundary of either the left platform surface 42 or the right platform surface 44. One end of a chain 198 is secured to the motor vehicle and a link of the chain 198 is attached to the chain claw hook 128 leaving a minimum amount of slack remaining in the chain 198. Then, the tension adjusting nut 132 is tightened to remove any remaining slack from the chain 198 without requiring any movement of the motor vehicle on the platform 46. Thus, the chain 198 extending between the motor vehicle and the chain claw hook 128 provides a tension coupling means for restraining the motor vehicle from moving away from the hold-back anchor 114 while the body of the motor vehicle is restored.

Figure 6:
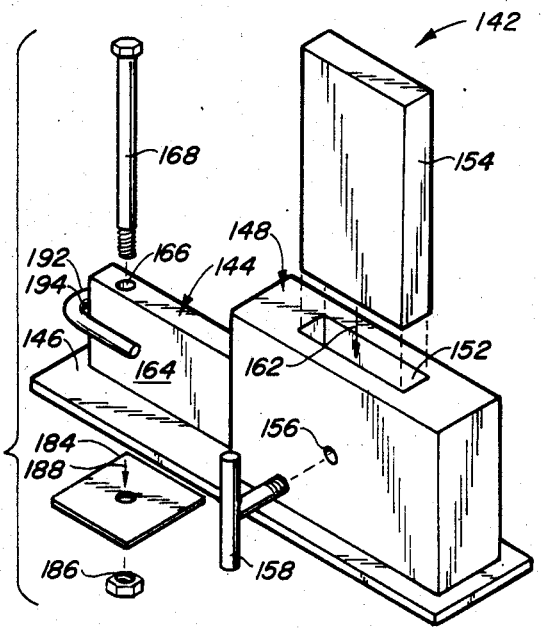
FIG. 6 is an exploded, perspective view depicting a bladed holding standard embodying the present invention adapted to be attached to the raised platform.

In addition to being used in securing a motor vehicle to the apparatus 20, the hold-back anchor 114 may be used in conjunction with other appliances such as a bladed holding standard 142 of the type illustrated in FIGS. 1 and 6. The bladed holding standard 142 includes an elongated body 144 which has a planar foot 146 adapted to rest upon the upper surface of the platform 46. A blade mounting fixture 148 projects upwardly above the foot 146 at one end of the body 144. A rectangularly shaped blade aperture 152 is formed in the blade mounting fixture 148 through its upper surface to receive an elongated holding blade 154 having a rectangular cross-sectional area. A threaded hole 156, which receives a T-shaped bolt 158, is formed in the side of the blade mounting fixture 148 to intersect with the blade aperture 152. After a holding blade 154 has been inserted into the blade aperture 152 as indicated by an arrow 162 (FIG. 6), the end of the T-shaped bolt 158 within the threaded hole 156 is tightened against the side of the holding blade 154 to lock the holding blade 154 within the body 144. Thus, the bladed holding standard 152 may be easily adapted for various situations encountered in restoring a deformed body of a motor vehicle by installing a holding blade 154 having an appropriate length into the blade aperture 152.

The body 144 also includes a tongue 164 extending outwardly from the side of the blade mounting fixture 148 over the foot 146. An anchor bolt hole 166 is formed through the end of the tongue 164 removed from blade mounting fixture 148 and through the foot 146 to receive an anchor bolt 168 when the bladed holding standard 142 is installed on the platform 46 as illustrated in FIG. 1.

To secure the bladed holding standard 142 to the frame 22, sliding anchor beams 172 (FIGS. 1 and 3) are supported across the central aperture 62 on anchor beam rails 4 (FIGS. 1 and 2). The rails 174 project outwardly into the central aperture 62 from the horizontally opposed sides of each of the inner beams 32, respectively. Each anchor beam 172 includes two elongated, rectangularly shaped anchor beam plates 176 (FIG. 1) which are disposed orthogonally to the anchor beam rails 174 and are joined together at their opposite ends adjacent to the inner beams 32. Thus, the two anchor beam plates 176 of each anchor beam 172 define an elongated, rectangularly shaped anchoring aperture 178 across the central aperture 62 between the inner beams 32. The ends of the anchor beams 172 engage the anchor beam rails 174 so the upper surface of the anchor beam plates 176 are substantially coplanar with the upper surface of the platform 46. The anchor beams 172 are installed onto the anchor beam rails 174 by being lowered between the inner beams 32 adjacent to the rear beam 58 in a location in which the anchor beam rails 174 are absent. The anchor beams 172 are then moved horizontally onto the anchor beam rails 174 and are subsequently restrained from falling off the end of the anchor beam rails 174 adjacent to the rear beam 58 by bolts 182 secured through each of the inner beams 32. Thus, the anchor beams 172 together with the anchoring aperture 178 may be moved horizontally along the anchor beam rails 174 to any location along the length of the central aperture 62.

To install the bladed holding standard 142, one of the anchor beams 172 is moved along the anchor beam rail 174 to the location at which the bladed holding standard 142 is to be installed. Then, the bladed holding standard 142 is lowered onto the upper surfaces of both the platform 46 and the anchor beam plates 176 so the anchor bolt hole 166 in the tongue 164 aligns vertically with the anchoring aperture 178 (FIG. 1). The anchor bolt 168 is then inserted through the aligned anchor bolt hole 166 and anchoring aperture 178 to pass through a beam anchor plate 184 (FIG. 6) which is located immediately beneath the anchor beam 172 (FIG. 1) for engagement with a nut 186 as illustrated by the arrow 186 in FIG. 6.

Secured to the tongue 164 on each side of the anchor bolt hole 166 is a U-shaped chain hook bracket 192 (FIGS. 1 and 6) which defines a chain hook anchor hole 194 between the chain hook bracket 192 and the end of the tongue 164 removed from the blade mounting fixture 148. After the bladed holding standard 142 has been secured to the anchor beam 172 with the anchor bolt 168, a hook 196 (FIG. 1) is fastened to one end of the chain 198 and is inserted through the chain hook anchor hole 194 to engage the chain hook bracket 192 (FIG. 6). Installation of the bladed holding standard 142 is then completed by extending the remaining portion of the chain 198 across the platform 46 to the hold-back anchor 114 (FIG. 1). A link of the chain 198 is engaged by the chain claw hook 128 (FIG. 5) of the hold-back anchor 114. Finally the tension adjusting nut 132 of the hold-back anchor 114 is tightened to remove all slack from the chain 198. Thus, the chain 198 (FIG. 1) extending between the chain hook bracket 192 of the bladed holding standard 142 and the chain claw hook 128 of the hold-back anchor 114 provides a tension coupling means for restraining the bladed holding standard 142 from moving with respect to the platform 46 while a deformed body of a motor vehicle is being restored. The use of a tension coupling means in restraining the bladed holding standard 142 from moving provides a bladed holding standard 142 which cannot move with respect to the platform 46 while a deformed body of a motor vehicle is being restored.

Once a motor vehicle has been appropriately secured to the platform 46 of the apparatus 20, a force is applied to the body thereof to effect the repair. Referring to FIGS. 1 and 2, the apparatus 20 includes a plurality of inverted, F-shaped pull-towers 202 which may be activated for applying a restoring force to the body of a motor vehicle while the vehicle is secured on the platform 46. Each pull-tower 202 is supported on a track provided by the frame 22 to be movable to any location along a U-shaped path indicated by the arrows 204 in FIG. 1. Thus, the path indicated by the arrows 204 extends from the hinged supporting leg 72 associated with the left platform surface 42, around the front beam 52 and to the hinged supporting leg 72 associated with the right platform surface 44. The dashed outline of the pull-tower 202 depicted on one side of FIG. 2 illustrates a possible location to which one of the pull-towers 202 may be moved.

To allow turning movement of the pull-towers 202 at the ends of the left and right frame members 26 and 28 removed from the hinged supporting legs 72, the frame 22 includes two upper surfaces 206 (FIG. 1) which extend respectively outwardly from the left and right platform surfaces 42 and 44. The surfaces 206 are disposed below the flange 112. One half of the track which supports the pull-towers 202 and along which they may be moved is provided by the contiguous upper surfaces of the outer beams 34, the upper surfaces 206 and the front beam 52. The other half of this track is provided by a U-shaped pull-tower rail 208 (FIGS. 1 and 2) secured to the lower surfaces of the inner beams 32 and the forward beam 54.

Figure 7:
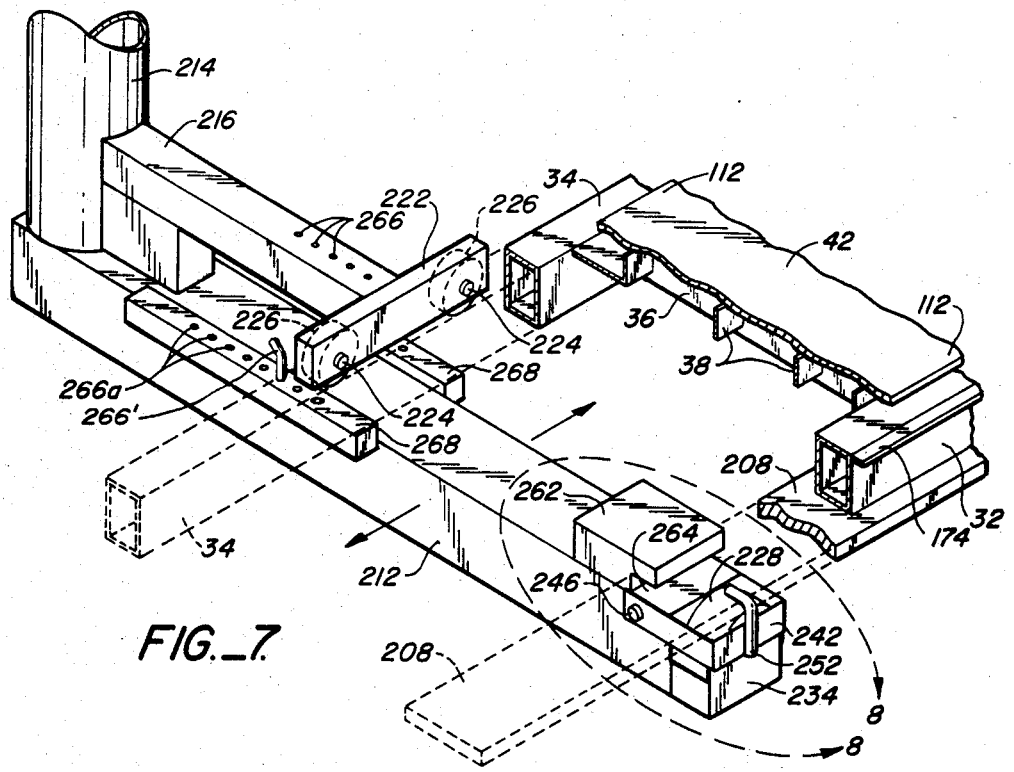
FIG. 7 is a perspective view partially in section taken along the line 7—7 of FIG. 1 illustrating a section of the track upon which the pull-towers are movably supported.

To engage the lower half of the track provided by the U-shaped pull-tower rail 208, each pull-tower 202 includes an elongated, hollow rectangularly shaped lower tower support beam 212 (FIGS. 1 and 2) which extends inwardly beneath the pull-tower rail 208 from the base of a cylindrically shaped, vertically oriented vertical post 214. For engaging the upper half of the track provided by the contiguous upper surfaces of the outer beams 34, upper surfaces 206 and the front beam 52, each pull-tower 202 includes a shorter, smaller square shaped upper tower support beam 216 above the lower tower support beam 212 which extends inwardly from the vertical post 124 about the outer beam 34. Referring now to FIG. 7, secured to the end of the upper tower support beam 126 immediately above the outer beam 34 and disposed along the length thereof is a rectangularly shaped upper wheel housing 222. Rotatably mounted on a upper wheel mounting bolt 224 at each end of and within the upper wheel housing 222 and contacting the upper surface of the outer beam 34 is an upper tower support wheel 226. Enclosed within the end of the lower tower support beam 212 immediately beneath the pull-tower rail 208 and contacting the lower surface thereof is a single lower tower support wheel 228.

Figure 8:
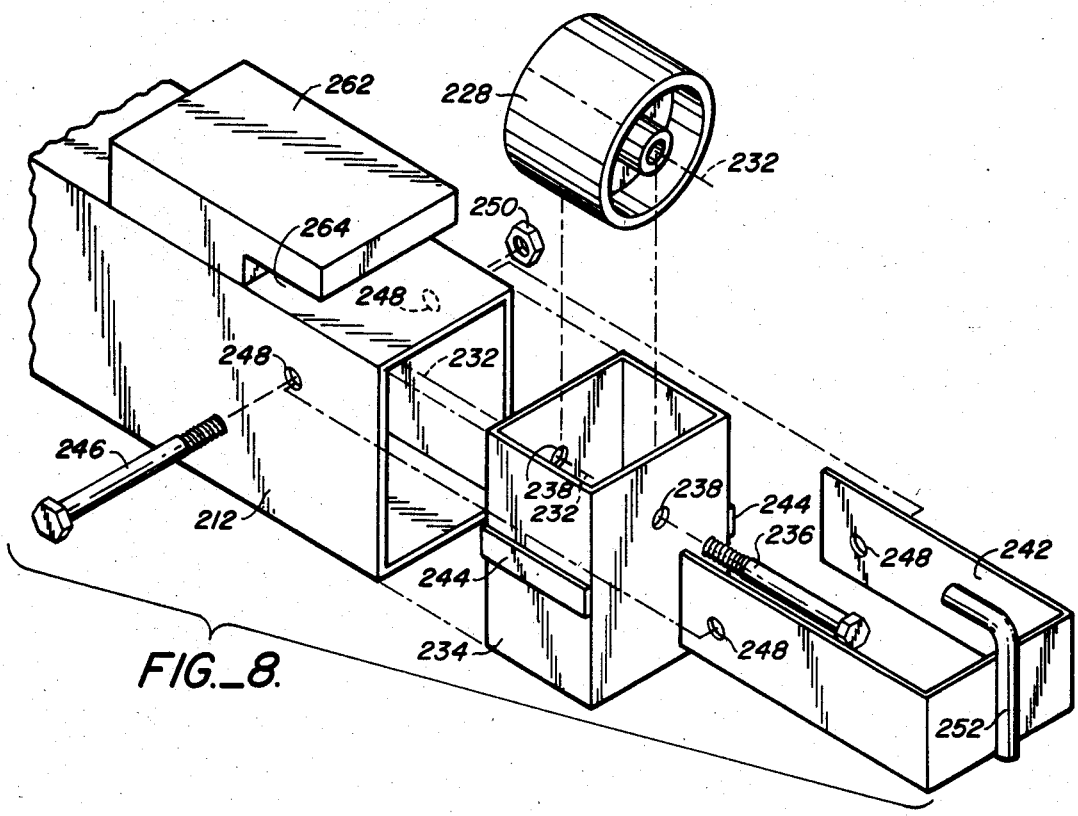
FIG. 8 is an exploded, perspective view taken along the line 8—8 of FIG. 7 depicting the structure which urges the pull-tower to move inwardly toward the frame if the pull-tower fails while a repair of the motor vehicle is being made.

Referring to FIG. 8, the lower tower support wheel 228 is supported for rotation about an axis 232 within a hollow, rectangularly shaped lower wheel mounting housing 234. Mounting the lower tower support wheel 228 for rotation within the lower wheel mounting housing 234 is a threaded lower wheel mounting axle 236 which passes through and is secured within lower wheel mounting apertures 238 formed through the walls of the lower wheel mounting housing 234. The lower wheel mounting housing 234 with the lower tower support wheel 228 mounted therein is securely attached to the end of the lower tower support beam 212. The upper half of the lower wheel mounting housing 234 is encircled by a U-shaped end stop bracket 242 located immediately above end stop support bosses 244. The bosses 244 project from opposite sides of the lower wheel mounting housing 234 parallel to the axis 232. The end stop bracket 242 is secured by a bolt 246 which passes through confronting apertures 248 formed through both the lower tower support beam 212 and the end stop bracket 242. The bolt 246 is secured within the apertures 248 by nut 250. An inverted L-shaped end stop 252 is secured at the center of the end stop bracket 242 and as illustrated in FIG. 7, extends upwardly above the pull-tower rail 208 and inwardly toward the inner beam 32 to restrain the pull-tower 202 from moving outwardly on the frame 22 beyond a prescribed distance.

An inverted L-shaped pull-tower support block 262 (FIG. 7) secured to the upper surface of the lower tower support beam 212 defines a U-shaped slot 264. The slot 264 receives a side edge of the pull-tower rail 208 which extends horizontally outwardly from the inner beam 32 toward the outer beam 34. The slot 264 surrounding the side edge of the pull-tower rail 208 restrains the end of the lower tower support beam 212 adjacent thereto from moving downwardly from the pull-tower rail 208 and also restrains the pull-tower 202 from moving inwardly on the frame 22 beyond a prescribed distance.

The combined engagement of the end stop 252 and the pull-tower support block 262 with the pull-tower rail 208 prevents the upper tower support wheels 226 from moving off the upper surface of the outer beam 34, thereby retaining the pull-tower 202 on the track provided by the frame 22. There remains, however, sufficient freedom in the mounting of the pull-tower 202 on the frame 22 to allow the lower tower support beam 212 to be positioned along a diagonal line between the inner beam 32 and the outer beam 34. Thus, the pull-tower 202 may be disposed at an angle with respect to the inner and outer beams 32 and 34 in the event the force required to effect a repair needs to be applied in a direction which is not orthogonal to the inner and outer beams 32 and 34.

To maintain the pull-tower 202 at such an angle while the repairing force is being applied, a plurality of detent holes 266 are formed downwardly through the upper tower support beam 216. Similarly, bars 268 having a plurality of detent holes **266*a* formed therethrough are also secured to both sides of the lower tower support beam 212 extending outward from beneath the outer beam 34. After the pull-tower 202 has been disposed at the desired angle with respect to the frame 22, a pin 266' is inserted into the appropriate detent hole 266 or 266*a* to engage the outer boundary of the frame 22 as established by the outer surfaces of the outer beams 34 and the front beam 52. Thus, the pull-tower 202 may be secured at an angle with respect to the frame 22 while a repairing force is applied to the motor vehicle secured to the platform 46**.

Figure 9:
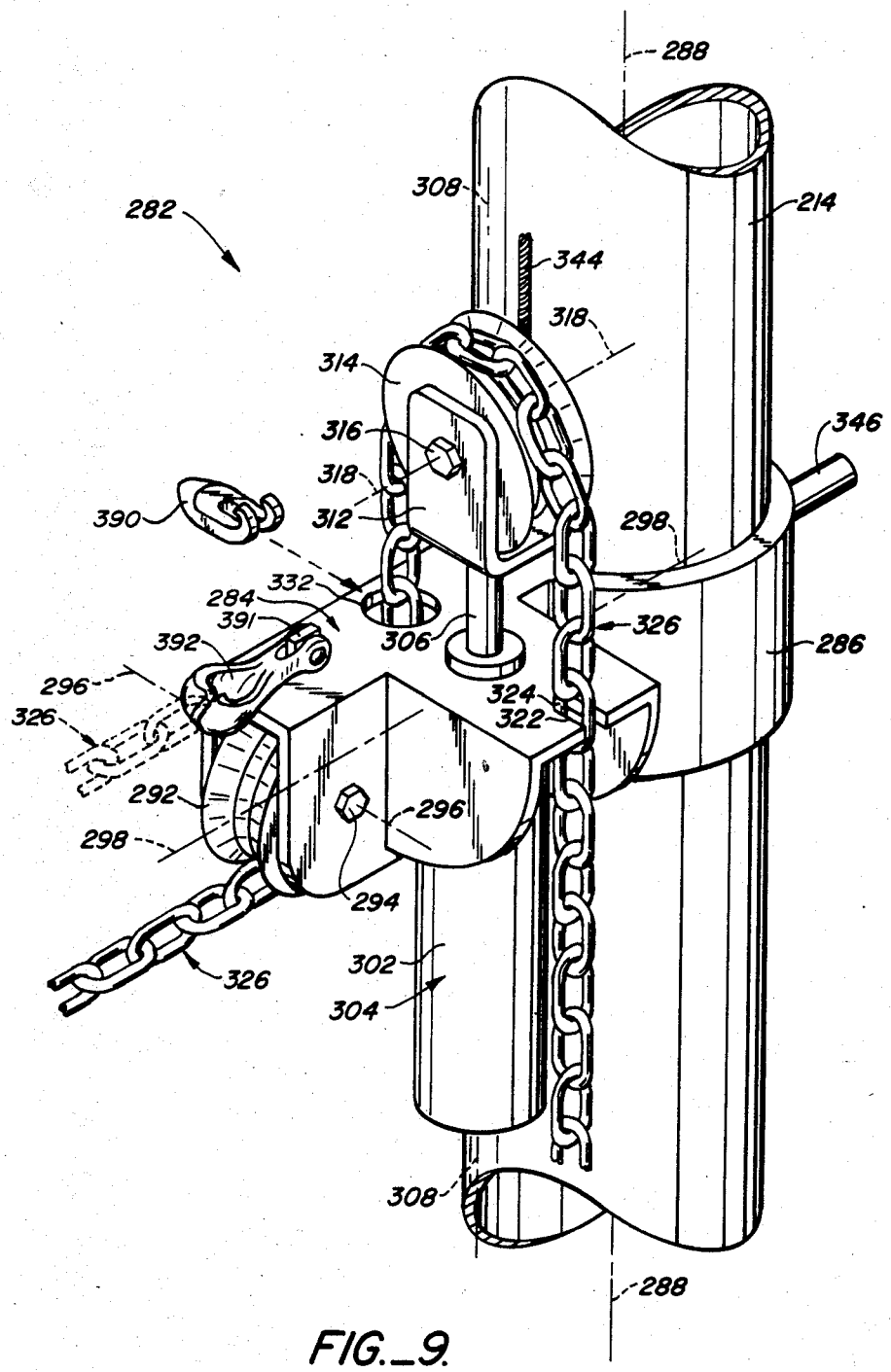
FIG. 9 is a perspective view taken along the line 9—9 of FIG. 1 depicting a pull-tower power head for applying a force to a vehicle secured to the platform of the apparatus.

Referring now to FIGS. 1 and 9, each pull-tower 202 includes a power head 282 which is activated to apply a repairing force to a motor vehicle. The power head 282 includes a frame 284 having a cylindrically shaped collar 286 adapted to encircle and be movable vertically up and down the vertical post 214 along an axis 288. Located at the end of the frame 284 remote from the vertical post 214 is an outer pulley 292. The outer pulley 292 is mounted on the frame 284 for rotation by a bolt 294 passing therethrough. The outer pulley 292 is rotatable about an axis 296, which is orthogonal to a radial line 298 extending outwardly from and perpendicular to the longitudinal axis 288 of the vertical post 214. The outer pulley 292 rotates in a plane passing through the axis of the post 214.

Secured to the frame 284 intermediate the axis 296 and the post 214 is a cylinder 302 of a hydraulic cylinder 304. The hydraulic cylinder 304 includes a piston 306 which extends out of or retracts into the cylinder 302 along an axis 308. The axis 308 is disposed perpendicularly to a plane which includes both the outer pulley axis 296 and the radial line 298. The piston 306 of the hydraulic cylinder 304 projects upwardly above the just-mentioned plane. Secured to the upper end of the shaft 306 is a U-shaped upper pulley mounting bracket 312 which supports an upper sprocket 314. The upper pulley 314 is mounted for rotation within the upper pulley mounting bracket 312 by a bolt 316. The upper pulley 314 is rotatable about an axis 318 which is parallel to the radial line 298.

The frame 284 of the power head 282 is formed with a U-shaped notch 322. A link 324 of a chain 326 is secured within the notch 322. The chain 326 extends upwardly from the notch 322 along an inverted, U-shaped path 328, over the upper pulley 314 and then downwardly through a chain hole 332 formed through the upper surface of the frame 284. Within the frame 284, the path 328 of the chain 326 contacts a segment of the surface of the outer pulley 292 and then extends outwardly therefrom to the location of a vehicle at which a restoring force is to be applied.

Each pull-tower 202 also includes a winch 342 (FIG. 1) secured to the top of the post 214. A cable 344 extends downwardly from the winch 342 adjacent to the post 214 and is secured to the frame 284 of the power head 282. Thus, the power head 282 may be easily moved up and down the post 214 using the winch 342 to be positioned at any desired location from which a restoring force is applied to the structure secured to the platform 46.

With a motor vehicle appropriately secured to the platform 46 of the apparatus 20, one of the pull-towers 202 is moved along the frame 22 to a location in which the longitudinal axis 288 of the post 214 lies in a plane in which a restoring force is to be applied. To facilitate moving the pull-towers 20 and positioning the power head 282 while preparing to apply a restoring force to a motor vehicle, the frame 284 includes a handle 346 which extends outwardly from the collar 286 on the side thereof opposite to that on which the outer pulley 292 is located. In moving the pull-towers 202 about the perimeter of the frame 22, the various appliances attached to the flange 112 do not obstruct movement of the pull-tower 202 because the perimeter of the frame 22 extends outwardly beyond and encompasses the outer boundary of the platform 46. If the plane of the restoring force is not orthogonal to the inner and outer beams 32 and 34, then the pin 266' is inserted into one of the detent holes 266 or **266*a* of the pull-tower 202 to engage the outer boundary of the frame 22. The track on which the pull-tower 202 travels defines outer boundaries for the frame 22**.

With the post 214 properly positioned, the winch 342 is used to raise or lower the power head 282 to the appropriate location from which the restoring force is to be applied to the vehicle. Generally a T-shaped bolt 348 enables the collar 286 to rotate freely and self-adjust to the direction of the restoring force, such as in the direction of a line 246. Should the restoring force be directed along a line which is not parallel to the radial line 296, then the collar 286 of the power head 282 is secured to the post 214 by tightening a T-shaped bolt 348 (FIG. 1) which is threaded through the collar 286. Because the present invention incorporates hydraulic cylinder 304 and the upper pulley 314 into the power head 282, the component of force which is directed either upwardly or downwardly along the post 214, if the restoring force is not applied parallel to the radial line 298, is only a small fraction of the total restoring force. Thus, the collar 286 encircling the post 214 need only resist a relatively small force.

With the power head 282 properly positioned, the end of the chain 326 having a hook 352 (FIG. 1) attached thereto is extended outwardly from the outer pulley 292 and secured to the appropriate location on the motor vehicle. Upon activating the hydraulic cylinder 304, the chain 326 applies a force generated by the upward movement of the upper pulley 314 to the location on the vehicle to which the free end of the chain 326 is secured, thereby applying a restoring force thereto.

As illustrated in FIGS. 2, 7 and 8, the chain 326 transmits the restoring force from the power head 282 to a motor vehicle that is secured to the platform 46 and urges the post 214 to move inwardly toward the frame 22. The inwardly directed force on the pull-tower 202 urges the support block 262 into contact with the pull-tower rail 208. Upon engagement of the block 262 with the rail 208, the restoring force urges the pull-tower 202 to pivot about the point of contact between the block 262 and the rail 208, thereby urging the detent hole bars 268 into engagement with the lower surface of the outer beam 34. The engagement between the detent hole bars 268 and the outer beam 34 urges the end of the lower tower support beam 212, which is being restrained by the pull-tower support block 262, to pivot toward the floor 24. If the combination of forces thus applied to the pull-tower support block 262 should cause it to fail, then the end of the lower tower support beam 212 to which the end stop bracket 242 is secured will move toward the floor 24. Such movement of the lower tower support beam 212 causes the end stop 252 secured to the end stop bracket 242 to engage the pull-tower rail 208 in a scissor-like action. The engagement between the end stop 252 and the pull-tower rail 208 in combination with downward motion of the immediately adjacent end of the lower tower support beam 212 urges the pull-tower 202 to move inwardly toward the frame 22, thereby preventing the pull-tower 202 from falling off the apparatus 20.

While restoring a deformed motor vehicle, it frequently becomes necessary to check the alignment of the wheels of the vehicle. The platform 46 in its raised position above the frame 22 in combination with the upper surfaces 206 facilitates making such wheel alignments. In particular, the height of the platform 46 above the upper surfaces 206 is selected such that when rotating turntable wheel alignment fixtures (not shown) are respectively placed onto each of the upper surfaces 206, the upper surface of the fixture provides an extension of the upper surface of the platform 46. Thus, a motor vehicle can be easily moved along the platform 46 to position the wheels of the vehicle on the upper surface of the rotating turntables of the alignment fixtures.

In checking wheel alignment should it become necessary to further restore a deformed vehicle, the apparatus 20 includes various features which permit easily securing the vehicle to the frame 22. Thus, a plurality of appliance securing apertures 362 are formed through the upper surfaces 206 of the frame 22 to secure various appliances in the same manner as they are usually secured to the flange 112. Furthermore, the frame 22 includes a forward aperture 364 encompassed by the horizontally opposed sides of the two inner beams 32 respectively of the left and right frame members 26 and 28 which extend between the front beam 52 and the forward beam 54. Analogously with the central aperture 62 an anchor beam 172 is disposed across the forward aperture 364 and is supported there on anchor beam rails 174 projecting thereto from the sides of the inner beams 32.

Because the preferred embodiment of the present invention includes the hinged supporting legs 72 to facilitate moving a motor vehicle onto or off of the upper surface of the platform 46, the pull-towers 202 are not moved around the entire outer boundary of the frame 22.

To increase the alternative ways in which forces may be applied along the entire outer boundary of the frame 22, a plurality of hold back post apertures 382 (FIG. 1) are formed through the left and right platform surfaces 42 and 44 adjacent to the respective points at which the hinged supporting legs 72 are attached to the outer beams 34. The hold back post apertures 382 are adapted to receive a cylindrically shaped hold back post 384 to which a chain (not shown) is secured for restraining a structure while a restoring force is applied thereto. Each hold back post 384 has a pin 386 passing through it to limit the depth to which the hold back post 384 may enter down into the hold back post aperture 382. Similarly, a tube 388 is secured to the top of the hold back post 384 to receive a threaded rod 126 to one end of which is attached a cup-shaped chain claw hook 128 and to the other end of which is secured a tension adjusting nut 132. The hold back anchor 114 is adapted to fit in a slot 362 of the frame members 26 and 28.

In the event it is desired to increase the force applied to the chain 326 when the piston 306 has been fully extended, a claw hook 390 (FIG. 9) is temporarily inserted in a link of the chain 326 and in the aperture of the frame 284 to hold the chain 326 under tension. A claw hook 392 is bolted to the frame 284 through an ear 391. The free end of the chain 326 is removably secured to the claw hook 392. Suitable means is then applied to the chain 326 to increase the force applied thereto while the claw hook 390 is removed from the chain 326.

What is claimed is:

1. A device for use in apparatus for repairing a deformed, yieldable structure, said device comprising:

(a) a planar base;

(b) a blade mounting fixture with a planar bottom supported by said base, said blade mounting fixture being formed with a blade aperture;

(c) a holding blade disposed in said blade aperture;

(d) means adjustably movable within said blade mounting fixture for locking said holding blade within said blade mounting fixture;

(e) anchoring fixture with a planar bottom extending from said blade mounting fixture and disposed on said base adjacent said blade mounting fixture;

(f) anchoring means attached to said anchoring fixture for holding said base at a predetermined location; and (g) attachment means on said anchoring fixture for applying a pulling force thereto.

* * * * *